US006247656B1

(12) United States Patent
Wales et al.

(10) Patent No.: US 6,247,656 B1
(45) Date of Patent: Jun. 19, 2001

(54) SHOWER HEAD

(75) Inventors: Michael Wales, Riverside; Roland Lagasse, South Windsor, both of CT (US)

(73) Assignee: Resources Conservation, Inc., Stamford, CT (US)

( * ) Notice: Subject to any disclaimer, the term of this patent is extended or adjusted under 35 U.S.C. 154(b) by 0 days.

(21) Appl. No.: 09/559,811

(22) Filed: Apr. 26, 2000

(51) Int. Cl.[7] ..... B05B 1/14
(52) U.S. Cl. ..... 239/552; 239/596
(58) Field of Search ..... 239/548, 552, 239/553.3, 553.5, 596, 590, 590.3, 590.5, 602, 462, DIG. 23; 4/615

(56) References Cited

U.S. PATENT DOCUMENTS

| | | | | |
|---|---|---|---|---|
| 515,669 | | 2/1894 | Fry . | |
| 2,998,932 | * | 9/1961 | Aghnides | 239/552 |
| 3,313,490 | | 4/1967 | Loveland . | |
| 3,537,543 | | 11/1970 | Gibel . | |
| 3,630,444 | | 12/1971 | Nelson . | |
| 3,640,472 | | 2/1972 | Hruby, Jr. et al. . | |
| 5,381,957 | | 1/1995 | Bianco . | |
| 5,626,295 | | 5/1997 | Heyse et al. . | |

* cited by examiner

*Primary Examiner*—Lisa Ann Douglas
(74) *Attorney, Agent, or Firm*—St. Onge Steward Johnston & Reens LLC

(57) ABSTRACT

A spray assembly includes a spray director having a formation on its inner peripheral wall and a dispersal plate provided with an array of bent legs which are formed on the plate's edge and resiliently engage the formation to lock the dispersal plate in place upon it insertion in the spray director.

11 Claims, 2 Drawing Sheets

SHOWER HEAD

FIELD OF THE INVENTION

This invention relates to water mixing and dispensing devices, and more particularly to a water spray assembly properly functioning during a long period of time. Specifically, the invention relates to a combination of a water spray director and a dispersal plate reliably engaging the water director and a method of manufacturing this combination.

BACKGROUND OF THE INVENTION

A wide variety of shower heads have been devised and used, ranging from simple sprinkling can type which provides a cluster of small streams of water to complicated and frequently adjustable heads which supply a wide range of shower patterns. While many details of these structures are vastly different, practically all of them have a spray assembly creating a plurality of water jets.

A shower head directs water from a shower fixture to a user in a stream or spray. Adjustable shower heads permit the user to select a wide variety of shower spray options. For example, a user may select a "fine" spray that distributes water in thin streams. Similarly, a user may select increasingly stronger sprays that distribute water in stronger, thicker streams. Fine sprays are often used to provide gentle rinsing action over a wide area. Strong sprays are used to provide intense massage action to one particular area.

Strong massage sprays are produced by directing all water flow through a central opening in a spray director of the shower head. Using a spray ring or dispersal plate disposed in the spray director often produces fine spray.

The dispersal plate typically has an outer surface formed complementary to an inner periphery of the spray director and defined by an edge, which engages formations provided on the inner periphery of the spray director. Such engagement permits water to flow through an array of small apertures formed in the dispersal plate and breaking a stream of water into a multiplicity of water jets.

A process of manufacturing the spray director usually involves a machine provided with a drilling tool, which is driven to traverse a blank. The blank is held in a position wherein its longitudinal axis extends parallel to displacement of the drilling tool which typically makes a central bore in the blank extending between inner and outer ends of the blank. Once this operation is completed, the blank is remounted to have its axial ends inverted for tapping the outer end of the blank.

As a consequence, an inner peripheral wall which may narrow toward its threaded outer end is formed and has an annular flange which separates the threaded outer end from the rest of the wall and may serve as a seat for a dispersal plate.

As known from the prior art which is illustrated in FIGS. 1 and 2, a dispersal plate 18 is typically a thin annular plate made of metal and having an array of small orifices 20 which may be arranged in a circular pattern spaced radially from the plate's edge.

Referring to FIG. 2, a rather typical spray director 10 has an inner peripheral wall extending between an inner end 12 and an outer end 14 which, in turn, is provided with a thread 16, as explained above. An annular flange 22 receives a dispersal plate 18 pneumatically pushed to sit on the flange 22 while gripping the wall with its edge. A stream of water entering the inner end 12 encounters the dispersal plate having an array of orifices that break the stream in a plurality of water jets delivered to a user.

As mentioned above, a process of manufacturing the spray director typically necessitates remounting of a blank in order to tap one of the opposite ends of the blank and, thus, may be rather complex and time consuming.

Also, a position of a dispersal plate during its installation within the spray director may not be properly centered along a center axis of the director due to the deformation of the plate during its displacement. Moreover, while current designs of the dispersal plate may operate satisfactorily while new, after a period of use it may be subject to deformations hampering the engagement with the spray director. All of it may easily lead to a rather high manufacturing cost and multifunction of the spray director during its use.

It is, therefore, desirable to provide a method of manufacturing a spray director without having a tool blank to be machined readjusted after a central bore has been made. It is also desirable to provide a method of ensuring a proper position of a dispersal plate within the spray director, as is the dispersal plate which has a structure facilitating and ensuring properly positioning of the dispersal plate during its displacement along the spray director.

SUMMARY OF THE INVENTION

This is achieved by a method of forming a spray director without readjusting a tool blank on a working station of a multi-spindle bar machine and by one dispersal plate having its edge which is provided with an array of engaging elements gripping the inner periphery of the spray director.

According to one aspect of the invention, a blank to be machined is centered in a position, wherein a drilling tool drills a central bore. Afterwards, without dismounting the tool, a thread is formed by a threading tool brought up in an alignment with the bored blank and displaceable to tap an outer end of the blank. Further, a recessing tool is displaced in alignment of the bored and tapped blank to provide a recess in the vicinity of the outer end next to the thread. Initially recessing the inner peripheral wall of the spray director and, subsequently, tapping the outer end thereof may reverse a sequence in which the last two steps are performed.

In accordance with another aspect of the invention, a dispersal plate has an array of angularly spaced apart legs, wherein a distance between diametrically spaced legs is grater than a diameter of a region of the inner peripheral wall against which the legs resiliently urge.

According to still another aspect of the invention, the legs are bent with respect to a plane of the plate and have a degree of flexibility to resiliently engage an inner peripheral wall upon displacement of the plate toward the inner end of the spray director. Particularly, the legs formed on the edge are bent upwardly toward an inner end of the spray director at an angle varying from 10° to 20°.

Particularly, an inner peripheral wall of the spray director has a peripheral groove receiving the legs of the dispersal plate to center the dispersal plate in a predetermined position regardless of possible misalignment of the plate during its displacement toward an outer end of the spray director.

As a consequence, the bent legs of the dispersal plate spring into the groove and lock in place upon displacement of the dispersal plated toward the outer end of the spray director.

It is therefore an object of this invention to provide a method of manufacturing a spray assembly including a spray director which remains in the same position during its entire manufacturing process.

Still another object of the invention is to provide a spray director having peripheral groove receiving a dispersal plate to lock the dispersal plate in a centered position, wherein it lies generally perpendicular to a longitudinal axis of the spray director.

Yet a further object of the invention is to provide a dispersal plate having an array of bent flexible legs which are formed on a peripheral edge of the plate to resiliently engage a peripheral groove of the spray director and lock in place.

BRIEF DESCRIPTION OF THE DRAWINGS

The above and other objects, features and advantages will become more readily apparent from a detailed description of the preferred embodiment of the invention accompanied by the following drawings, in which.

DETAILED DESCRIPTION OF THE DRAWINGS

Figure 3:
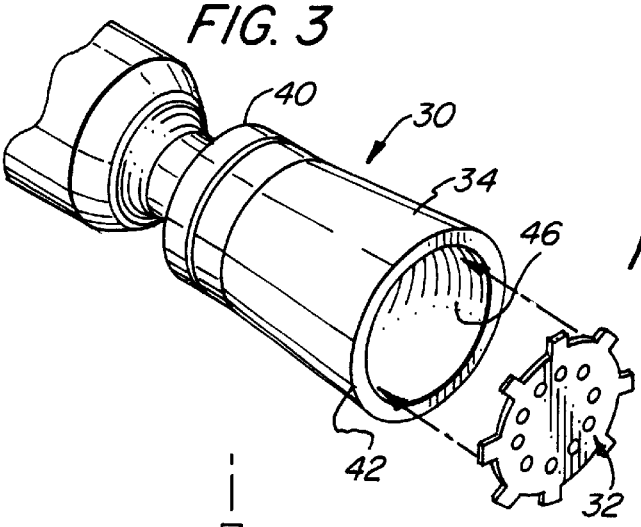
FIG. 3 is an isometric view of a spray assembly in accordance with the invention.
Figure 8:
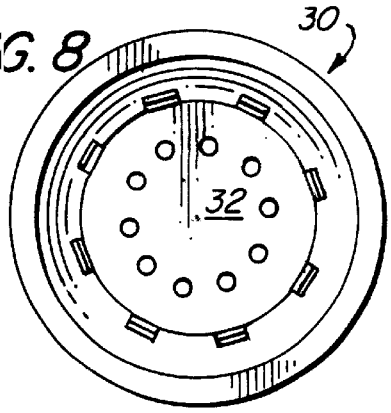
FIG. 8 is a top view of the dispersal plate of FIG. 6 installed in a spray director.

Referring to FIGS. 3–10, and particularly to FIG. 3, a spray assembly 30 provides a locking engagement between a dispersal plate 32 and a spray director 34, thereby ensuring a proper positioning of the dispersal plate upon its installation.

Figure 4:
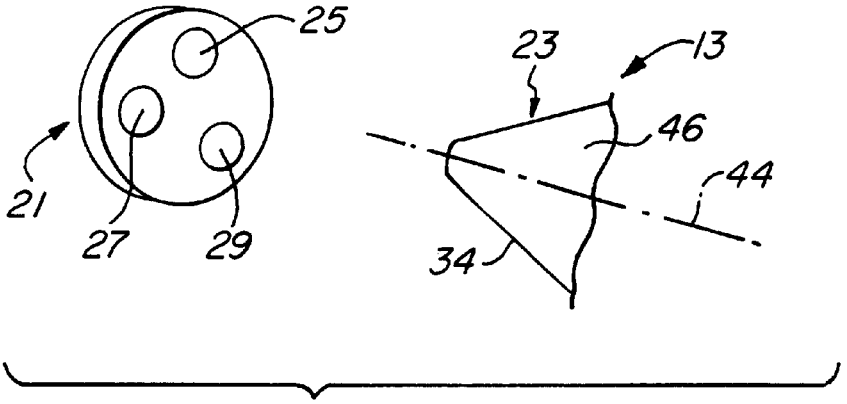
FIG. 4 is a diagrammatic view of an automatic multi-spindle bar machine showing a working station which carries a plurality of tools for machining a blank.

The spray director 34 is machined by utilizing an automatic multi-spindle bar machine, shown diagrammatically in FIG. 4 only for illustrative purposes. A blank 23 is mounted on a working station of the bar machine in a predetermined position, which remains unchanged during the entire process of machining the spray director 34, thereby manipulating only a multiplicity of tools without dismounting the blank until the process is completed.

Particularly, the bar machine 13 has a tool station 21 carrying a multiplicity of tools including among others drilling 25, tapping 27 and recessing 29 tools. Each of the tools is brought in alignment with an axis 44 of the blank 23 to perform a respective operation. The bar machine is indexed to have each of these tool rotated in a predetermined position wherein the tool is positioned coaxially with the blank 23.

Figure 5:
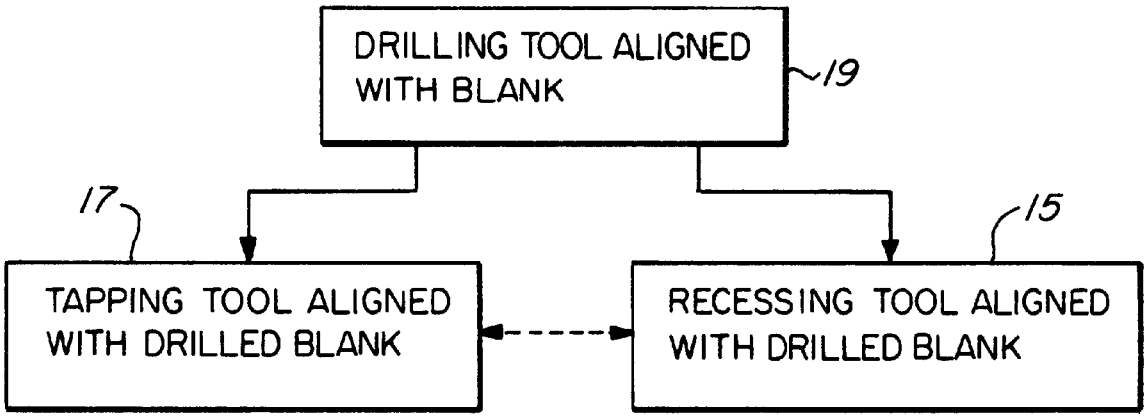
FIG. 5 is a flow chart showing a process in accordance with the invention.
Figure 2:
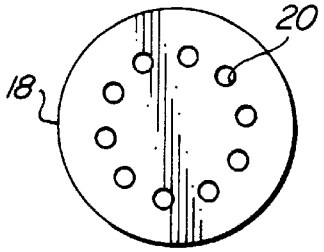
FIG. 2 (PRIOR ART)
FIG. 2 is a section of a spray director along with the dispersal plate of FIG. 1 characteristic of a known prior art and taken along a longitudinal axis of the spray assembly.

Referring to FIG. 5, the drilling tool 25 is rotated to a position wherein it is aligned with the blank to drill a thoroughgoing bore 46 extending between inner 42 and outer 40 ends of the to be spray director, a shown by a step 19. Further, depending on a particular programming of the machine, either the recessing tool or tapping tool is rotated in a position to perform a respective operation at 17 and 15, respectively.

As a consequence, an initial position of the spray director, in accordance with the invention, remains untouched during the entire process including drilling the bore, tapping the outer end to form a thread 48 and recessing an inner periphery with an annular recess 50.

The annular recess 50 obviously has a larger diameter than regions of the inner periphery surrounding the recess and preferably is located next to the thread 48 in a neck 52 of the spray director, which may have the narrowest cross-section of the entire body.

Figure 6:
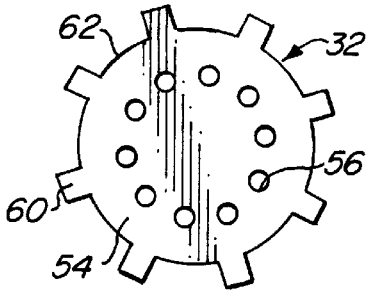
FIG. 6 is plan view of a dispersal plate in accordance with the invention.

Turning to FIG. 6, the dispersal plate 32, in accordance with the invention, is an annular plate having a body 54 which is perforated with an array of orifices 56 breaking a stream of water entering the inner end 42 of the spray director in a multiplicity of water jets.

Figure 1:
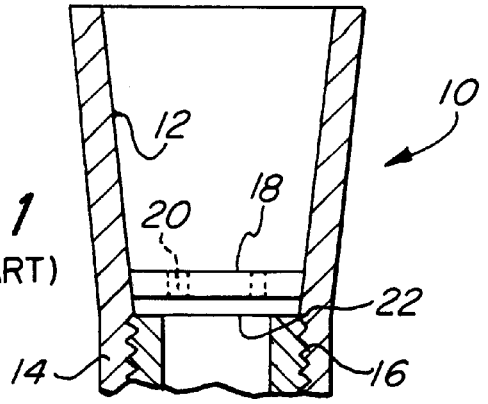
FIG. 1 (PRIOR ART)
FIG. 1 is a plan view of a dispersal plate in accordance with the known prior art.
Figure 6A:
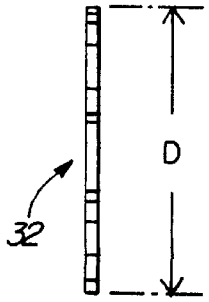
FIG. 6A is a side view of the dispersal plate of FIG. 6.
Figure 7:
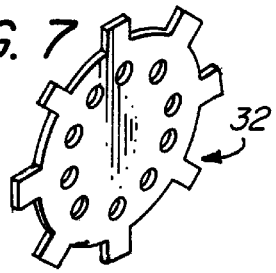
FIG. 7 is an isometric view of the dispersal plate of FIG. 6.
Figure 10:
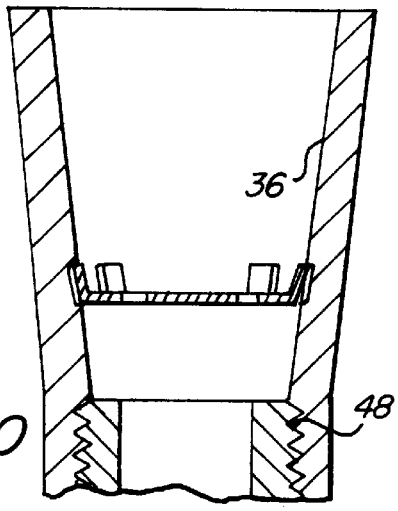
FIG. 10 is an axial view similar to the one shown in FIG. 9 but with the dispersal plate locked in a groove, which is provided in the spray director.

In accordance with an aspect of the invention, the dispersal plate 32 is distinguished over the prior art dispersal plate 18 (FIG. 1) by an array of legs 60 (FIG. 6) which are provided on a rim 62 of the body 54 to lock in the recess 50 (FIG. 10). The legs are spaced angularly from one another and their number can vary depending on a particular type of spray assembly. Each of the legs 60 is flexible and, preferably, is bent with respect to the body to extend toward the inner end of the spray director 34 at an angle ranging from 10° to 20° defining an outer diameter D of the plate, as shown in FIG. 6A.

Figure 9:
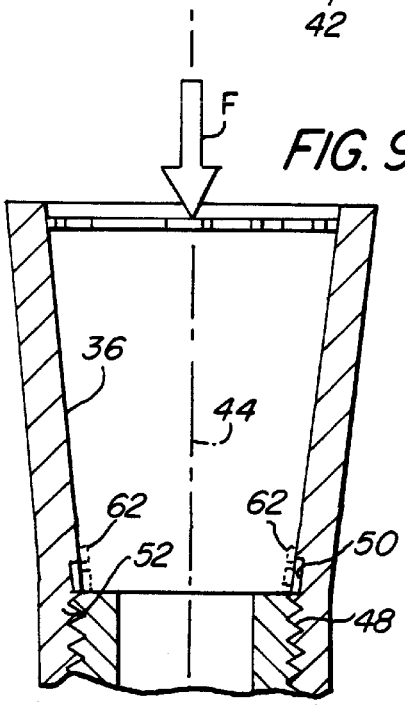
FIG. 9 is an axial section of the spray director of FIG. 5 with a dispersal plate shown in its initial position.

Referring to FIG. 9, the dispersal plate is forcibly, for example, pneumatically pushed toward the neck 52 of the spray director until the legs 60 engage the recess 50 to lock the plate in the spray director. Due to the bend, once the legs reach the level of the recess, they spring into it thus automatically centering the dispersal plate in a plane perpendicular to the axis 44. The engagement between the dispersal plate and the spray director, as better seen in FIG. 10, is reliable and can withstand pressure drops, partial clogging and other numerous causes that may lead to malfunctioning of the spray assembly during a prolonged course of its exploitation.

Alternatively, the inner wall of the spray director can be formed with at least one, and possibly two axially spaced apart projections 62 (FIG. 9) each of which extends radially inwardly. Similarly to the above described embodiment, the plate is pushed under an external force F toward the neck 52 to have its legs resiliently deflected to engage the underside of the innermost projection and locked between the projections providing a reliable engagement during its use.

Having the array of flexible legs 60 may provide a reliable grip with the inner peripheral wall 36 of the spray director even without forming formations in this wall. Due to inherent resilience and its outer dimension, the dispersal plate 32 can be pushed upon applying the force F (FIG. 9) toward a region of the neck 52 which is dimensioned to be less then the diameter D of the plate. Upon reaching its inward position, the legs tend to spread radially outwardly thereby gripping the inner peripheral wall.

Although the invention herein has been described with reference to particular embodiments, it is to be understood that the embodiments are merely illustrative of the principles and applications of the present invention as defined by the claims.

What is claimed is:

1. A spray assembly comprising:

a spray director formed of a hollow body having an inlet end and a discharge end, and a bore bounded by an inner wall which extends along a longitudinal axis; a dispersal plate insertable into said bore of said spray director to be axially displaced to a rest position and having an edge; and an array of legs spaced angularly apart along said edge and extending radially outwardly and angularly toward the inlet end of the hollow body therefrom to resiliently engage the inner wall in said rest position of the dispersal plate to prevent its further displacement.

2. The spray assembly defined in claim 1 wherein the inner wall has a frustoconical shape.

3. The spray assembly defined in claim 2 wherein said dispersal plate being sized and shaped to be insertable into said inlet end of the hollow body.

4. The spray assembly defined in claim 3 wherein the dispersal plate has a perforated planar body delimited by the edge.

5. The spray assembly defined in claim 1 wherein the inner wall has an annular recess for receiving the legs in said rest position of the dispersal plate.

6. The spray assembly defined in clam 5 wherein the inner wall is cylindrical, said annular recess having a peripheral edge locking the dispersal plate with an outward engagement of the legs in said annular recess in said rest position thereof.

7. The spray assembly defined in claim 5 wherein the legs of the dispersal plate are spring biased as the dispersal plate is inserted into the bore of the spray director and the dispersal plate comes to the rest position with an outward engagement of the legs in said annular recess in said rest position.

8. The spray assembly defined in claim 4 wherein the recess is sized to have its diameter less than a diametrical distance between opposite legs.

9. The spray assembly defined in claim 4 wherein each of the legs is bent at an angle ranging from 10° to 20° relative to the plane of the plate.

10. The spray assembly defined in claim 4 wherein the inner wall of the spray director has at least one flange provided with an underside and extending radially inwardly, the legs of the dispersal plate engaging the underside of the flange in the rest position of the dispersal plate.

11. A spray assembly comprising:

a spray director having inlet and discharge ends and an inner wall extending along a longitudinal axis between the inlet and discharge ends;

a dispersal plate having an edge juxtaposed with the inner wall, the dispersal plate and the spray director being axially displaceable relative to each other; and an array of bent legs spaced angularly apart along the edge of the dispersal plate and extending radially outwardly therefrom toward the inlet end of the spray director, the inner wall having a region between the inlet and discharge ends provided with a recess receiving the legs in a rest position of the dispersal plate, wherein relative displacement of the spray director and the dispersal plate is arrested.

* * * * *